US012601241B2

(12) United States Patent
Antel et al.

(10) Patent No.: US 12,601,241 B2
(45) Date of Patent: Apr. 14, 2026

(54) SUBSEA HEAT BANK WITH PCM HEAT STORING MEMBER

(71) Applicant: BAKER HUGHES ENERGY TECHNOLOGY UK LIMITED, Nailsea Bristol (GB)

(72) Inventors: William Joseph Antel, Aberdeenshire (GB); Emad Gharaibah, Akershus Hovik (NO)

(73) Assignee: Baker Hughes Energy Technology UK Limited, Bristol (GB)

( * ) Notice: Subject to any disclaimer, the term of this patent is extended or adjusted under 35 U.S.C. 154(b) by 0 days.

(21) Appl. No.: 18/835,853

(22) PCT Filed: Feb. 3, 2023

(86) PCT No.: PCT/EP2023/025051

§ 371 (c)(1),
(2) Date: Aug. 5, 2024

(87) PCT Pub. No.: WO2023/151864

PCT Pub. Date: Aug. 17, 2023

(65) Prior Publication Data

US 2025/0137354 A1 May 1, 2025

(30) Foreign Application Priority Data

Feb. 10, 2022 (GB) ..... 2201711

(51) Int. Cl.
*E21B 36/00* (2006.01)

(52) U.S. Cl.
CPC ..... *E21B 36/003* (2013.01); *E21B 36/005* (2013.01)

(58) Field of Classification Search
CPC ... E21B 36/003; E21B 36/005; E21B 41/0099
See application file for complete search history.

(56) References Cited

U.S. PATENT DOCUMENTS 6,415,868 B1 * 7/2002 Janoff ..... F28D 20/023 166/57
6,656,366 B1 * 12/2003 Fung ..... B08B 9/055 210/194
8,424,608 B1 * 4/2013 Lugo ..... E21B 36/005 166/57

(Continued)

FOREIGN PATENT DOCUMENTS

WO 02/12776 A1 2/2002
WO 02/16733 A1 2/2002
WO 2006/106406 A1 10/2006

*Primary Examiner* — Shane Bomar
(74) *Attorney, Agent, or Firm* — Hogan Lovells US LLP

(57) ABSTRACT

A subsea heat bank for thermally insulating one or more elements of a subsea installation. The heat bank comprises an external casing enclosing an internal space, one or more elements of the subsea installation received in the internal space and arranged such that seawater in the internal space surrounds them, and at least one heat storing member provided in the internal space for increasing the heat-storing capacity of the heat bank. The heat storing member comprising a phase change material (PCM) that has a melting point which is below that of the flow temperature of the well fluid and above the hydrate formation temperature of the well fluid.

18 Claims, 3 Drawing Sheets

(56) References Cited

U.S. PATENT DOCUMENTS

| | | | | |
|---|---|---|---|---|
| 2006/0131027 | A1 | 6/2006 | Chiesa et al. | |
| 2008/0277162 | A1* | 11/2008 | DiFoggio | E21B 47/0175 175/17 |
| 2014/0290902 | A1 | 10/2014 | Hande | |
| 2015/0153074 | A1* | 6/2015 | Antel, Jr. | F28D 1/0472 165/45 |
| 2016/0003558 | A1* | 1/2016 | Becquin | C10L 3/10 165/175 |
| 2017/0165809 | A1* | 6/2017 | Rosvold | E21B 33/038 |
| 2021/0221351 | A1* | 7/2021 | Novek | F03B 13/06 |
| 2021/0230976 | A1* | 7/2021 | Critsinelis | E21B 43/01 |
| 2022/0018230 | A1* | 1/2022 | Pakkan | E21B 43/01 |
| 2023/0375281 | A1* | 11/2023 | Konowalczyk | F24D 17/0015 |

* cited by examiner

SUBSEA HEAT BANK WITH PCM HEAT STORING MEMBER

TECHNICAL FIELD

The present disclosure relates to a subsea heat bank for thermally insulating one or more elements of a subsea installation.

BACKGROUND

In the field of subsea oil and gas production, well fluid is commonly produced and communicated from a well using a variety of subsea installations, such as pipelines, connectors, valves, manifolds and Christmas trees. Whilst the well fluid is relatively hot when it is flowing through these installations during production from the well, if production should be stopped or interrupted (e.g., for installation repair or maintenance) well fluid remaining therein will be cooled by the ambient cold sea water around it. It is known that such cooling of production well fluid can result in the formation of hydrates (or other solid formations) in the well fluid. The formation of such hydrates can block the flow path for the well fluid through the subsea installations, preventing or restricting further production of well fluid without first removing the hydrates.

To combat this effect, it is known to provide an insulation layer around one or more elements of a subsea installation. Where an insulation layer is not possible, a so-called heat bank can be utilised. In such a heat bank, an external casing is fitted around one or more elements of the subsea installation. Accordingly, the internal casing encloses an internal space around the one or more elements that is filled with seawater. During normal production, heat from the well fluid flowing through the subsea installation will warm the seawater in the internal space. When production is stopped or interrupted, the sensible heat accumulated in the seawater within the casing will be dissipated around the one or more elements over time. This can keep the well fluid therein above a hydrate formation temperature for a longer period of time. In this sense, the cool-down time (i.e., the amount of time production of well fluid through the installation can be stopped before hydrates start to form) can be increased using the heat bank.

Oil and gas producers are generally looking to increase the length of cool-down times for subsea installations where possible, and although the use of known heat banks may be satisfactory, the sensible heat storage capacity of the seawater therein can limit the cool-down time available for a given application.

One way to increase the heat storing capacity of known heat banks can be to increase the size of the external casing to enclose a larger volume of seawater around the subsea installation elements. However, this may negatively add weight and cost to the heat bank design. The increases in cool-down time may also not be great enough to justify these cost increases.

Accordingly, the present disclosure provides a heat bank for thermally insulating one or more elements of a subsea installation that improves the heat storing capacity of the heat bank to address the above.

SUMMARY

From one aspect, the present disclosure provides a subsea heat bank for thermally insulating one or more elements of a subsea installation. The one or more elements of the subsea installation are for communicating a flow path of well fluid there through having a flow temperature and a lower hydrate formation temperature at which hydrates will form in the well fluid. The heat bank comprises: an external casing enclosing an internal space configured to accommodate seawater having a heat-storing capacity therein; the one or more elements of the subsea installation being received in the internal space and arranged such that the seawater surrounds the one or more elements so as to allow the seawater to delay cooling of the one or more elements by heat stored in the seawater; and at least one heat storing member provided in the internal space for increasing the heat-storing capacity of the heat bank. The heat storing member comprises a phase change material (PCM) that has a melting point which is below that of the flow temperature of the well fluid and above the hydrate formation temperature of the well fluid.

In an embodiment of the above, the heat storing member comprises a container enclosing and sealing the PCM therein.

In a further embodiment, the container defines at least one fluid channel therein for communicating seawater from the internal space through the container without contacting the PCM sealed within the container.

In yet a further embodiment of either of the above, the container is substantially brick shaped. In one example, the container defines a first set of fluid channels extending vertically through the container and a second set of channels extending horizontally through the container.

In an alternative embodiment to the above, the container is a closed tubular element. In one example, the container is a closed helical tubular element.

In a further embodiment of the above, a plurality of tubular element containers are arranged in an array.

In a further embodiment of any of the above, the heat storing member is attached to the external casing.

In a further embodiment of any of the above, the heat storing member is in physical contact with a portion of the one or more elements.

In a further embodiment of any of the above, the external casing includes an insulating coating on the exterior thereof for thermally insulating the external casing from ambient seawater surrounding it.

In a further embodiment of any of the above, a plurality of heat storing members are arranged within the internal space and around the one or more elements.

In a further embodiment of any of the above, the one or more elements of the subsea installation provide a subsea connector.

In a further embodiment of any of the above, the subsea connector is a horizontal clamp connection system (HCCS).

In a further embodiment of any of the above, the heat storing member is positioned around the vicinity of a clamp of the HCCS for securing sections of pipeline together.

Although certain advantages are discussed below in relation to the features detailed above, other advantages of these features may become apparent to the skilled person following the present disclosure.

BRIEF DESCRIPTION OF DRAWINGS

One or more non-limiting examples will now be described, by way of example only, and with reference to the accompanying figures in which.

DETAILED DESCRIPTION

Figure 1A:
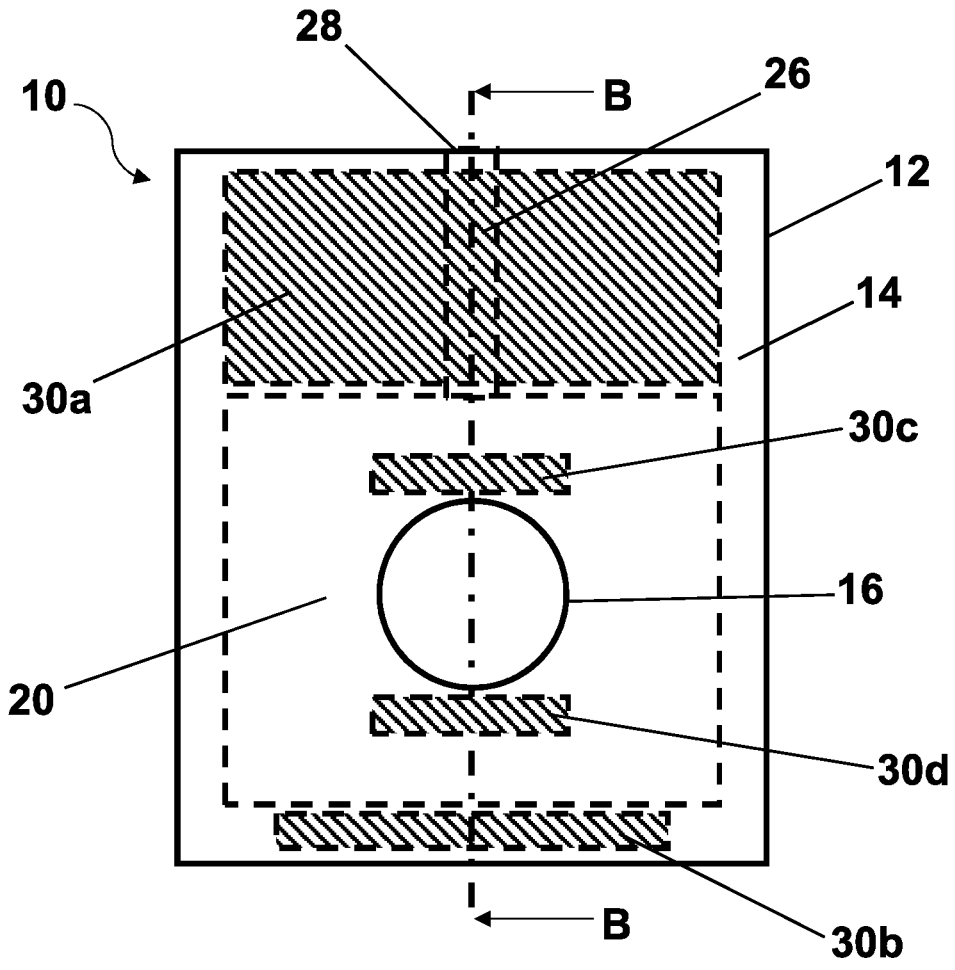
FIG. 1A shows a schematic, front view of a heat bank for thermally insulating a subsea connector in accordance with an embodiment of the present disclosure.
Figure 1B:
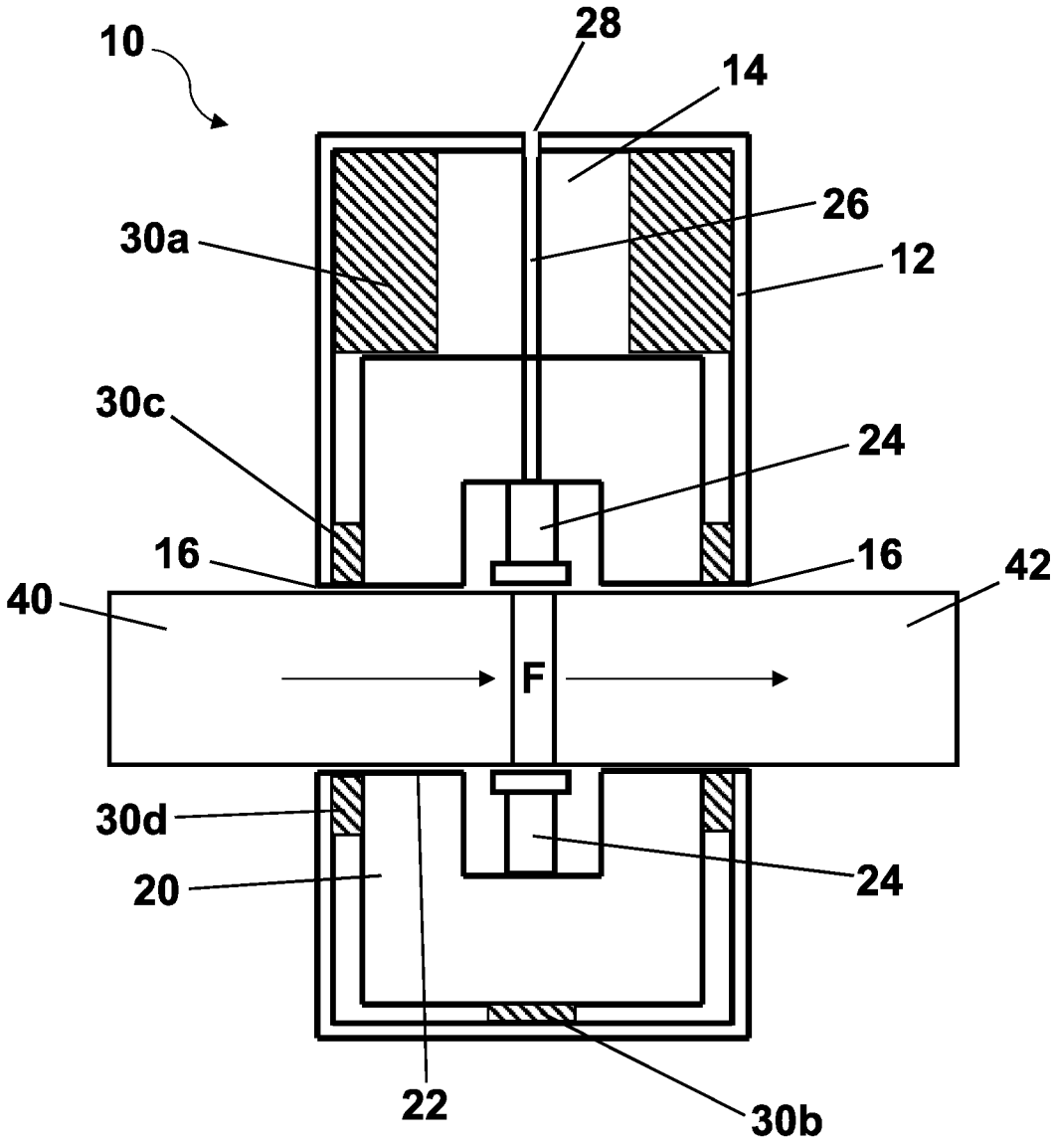
FIG. 1B shows a cross-sectional view of the heat bank of FIG. 1A along line B-B.

Referring to FIGS. 1A and 1B, a subsea heat bank 10 for thermally insulating a subsea connector 20 is schematically shown. In FIG. 1A, features that are visible from the exterior of the heat bank 10 are shown in solid lines, whereas internal features enclosed within the heat bank 10 are shown in dotted lines.

The heat bank 10 comprises an external casing 12 that encloses an internal space 14. Opposed openings 16 are provided through the heat bank 10 that is configured to receive sections of subsea pipeline 40, 42 therein, respectively. As discussed in more detail below, different sections of pipeline 40, 42 are secured within the openings 16 using the subsea connector 20.

The internal space 14 accommodates (i.e., is filled with) seawater from the subsea environment therein. The subsea connector 20 is received within the internal space 14 and is arranged such that the seawater held in the internal space 14 surrounds the subsea connector 20.

The subsea connector 20 is for connecting different sections of pipeline 40, 42 together. It defines a cylindrical passage 22 therein, which in combination with the openings 16 is configured to receive different sections of pipeline 40, 42 therein. One section of pipeline 40 is received via the left hand opening 16 and another section of pipeline 42 is received via the right hand opening 16. The different sections of pipeline 40, 42 protrude into the passage 22 from opposite sides of the connector 20 and are clamped together using clamps 24 circumscribing the passage 22. Clamping the sections of pipeline 40, 42 together will connect them together to allow the communication of well fluid from one section to the other. In this manner, the passage 22 may be referred to as providing a flow path F for well fluid through the connector 20.

The clamping function of the clamps 24 can be selectively actuated using a control line 26 that passes through the top of the heat bank 10. The control line 26 defines a port 28 at the top of the external casing 12 allowing communication therewith from outside the heat bank 10. The control line 26 may include any suitable control mechanism for actuating clamps 24. For example, it may receive hydraulic fluid or electrical signals to power actuators or a mechanical linkage driving the clamps 24.

As will be appreciated, the subsea connector 20 is a simplified depiction of a horizontal clamp connection system (HCCS). As discussed further below, this is a particular type of subsea connector 20 that it is thought may benefit from the present disclosure. Nonetheless, it is to be understood that any other suitable subsea connector 20 and/or connector arrangement for securing different sections of pipeline 40, 42 in place may also be employed within the scope of this disclosure (e.g., vertical clamp connection systems (VCCS)). Several such subsea connectors are known to the skilled person, and so will not be discussed in more detail here.

Moreover, within the scope of this disclosure, in other embodiments the subsea connector 20 can be used to connect any other suitable parts of a subsea installation. For example: a section of a Christmas tree spool 40 connecting to a jumper 42 (e.g., a connecting pipe/tie-in between subsea structures, such as a Christmas tree and a manifold); a section of a manifold spool 40 connecting to a jumper 42; a section of a Christmas tree spool 40 connecting to a flow control module 42; and connecting different Christmas tree flow blocks 40, 42; or the like.

Heat storing members 30*a-d* (shown schematically in hatched boxes) are provided in the internal space 14 for increasing the heat-storing capacity of the heat bank 10. The heat storing members 30*a-d* comprise a phase change material ("PCM") that has a melting point which is below that of the flow temperature of the well fluid and above the hydrate formation temperature of the well fluid.

In one example, production well fluid flowing through the subsea connector 20 can have a temperature in the region of 50° C. or greater, and hydrates can form therein at a temperature of around 20° C. The temperature of the ambient seawater around the heat bank 10 can be at a temperature of around 5° C. or less. In this case, the PCM melting point can be set to be between e.g., 30-40° C.

In this manner, when well fluid is flowing through the heat bank 10 and connector 20 during production, sufficient heat therefrom will be transferred to the PCM to melt it. The PCM will thus be held in liquid form in the heat storing members 30*a-d* during well fluid production. When production is stopped or interrupted, the cold subsea temperatures around the heat bank 10 and connector 20 will cause the PCM to cool to below its melting temperature, converting it into solid form. This will cause latent heat stored in the PCM to be released to heat the connector 20 and seawater in the external casing 12. This heat will be communicated to any well fluid remaining in the pipelines 40, 42 in the connector 20 to keep it above the hydrate formation temperature, which can help keep the well fluid flow path F clearer for longer. Indeed, in a simulated example it has been found that the heat bank 10 can improve the cool-down time of the subsea connector 20 by about 30% (e.g., to 20 hours or more) compared to a heat bank of the same size but with a conventional (seawater only) design.

As will be appreciated, this can allow production of well fluid through the connector 20 to be stopped or interrupted for longer, without costly or time consuming operations being needed to clear blockages from hydrates (or other solid deposits) when production is to be restarted. This can reduce operational costs and down time for well fluid production when using the heat bank 10.

Moreover, the PCM heat storing members can reduce the volume of seawater that is required to provide the required heat storing capacity for the heat bank 10. Thus, an improvement in the cool-down time can be realised without needing to increase the size and weight of the heat bank 10. The complexity of the heat bank design can also be reduced, as flow baffles or other internal features previously needed to improve the heat storing capacity of the seawater may be dispensed with (although, such internal features can still be used within the scope of the present disclosure, as required). Accordingly, the manufacture, design and installation costs for the heat bank 10 can also be reduced compared to known solutions.

Suitable PCMs are widely available, and their melting point can be readily tuned to suit different applications and hydrate formation temperatures for different subsea installations and well fluid conditions. A suitable PCM is a wax material, such as a paraffin or petroleum wax. Other suitable PCMs may include a hydrated salt or eutectic salt.

Although a plurality of heat storing members 30*a-d* are depicted, only at least one heat storing member need be used within the scope of this disclosure.

Moreover, within the scope of this disclosure, any suitable number and arrangement of PCM heat storing members may be used and placed around one or more elements of a subsea installation. The precise number and arrangement can depend, for example, on the configuration and geometry of the element(s) of the subsea installation, as well as the desired cool-down time and space available there around for the heat bank.

Moreover, the heat storing members 30*a-d* can be arranged around the connector 20 in particular "problem" areas. For example, in the case of the HCCS depicted in FIGS. 1A and 1B, the heat storing members 30*a-d* are placed around the vicinity of the clamps 24 to help keep them warmer for longer (and thus in better working order during a shutdown period). In other applications, heat storing members 30*a-d* may be concentrated in the vicinity of particular "cold spot" areas, that may not, for example, be as readily heated by the flow of well fluid during production. In such examples, the heat storing members 30*a-d* can be placed in physical contact with the connector 20 at the portion that is needed to be maintained at warmer relative temperatures for longer.

As shown in FIGS. 1A and 1B, the heat storing members 30*a-d* are attached to the external casing 12. The heat storing members 30*a-d* can then be dimensioned and arranged according to the geometry of the connector 20 to be enclosed, and according to whether they are to make physical contact therewith at certain portions or not. This can provide a convenient way of designing, manufacturing and assembling the heat bank 10 to enclose connector 20 (or other element(s)).

It will be appreciated that in this manner the heat bank 10 can either be assembled around an existing subsea connector 20 in situ in the sea or on the seabed, or integrated around one on land to form a one-piece unit that is then being submerged and positioned subsea. As will be appreciated by the skilled person, such in situ assembly operations can be achieved using unmanned submersible vehicles.

It is thought that the heat storing capacity and enhanced thermal communication of sensible and latent heat around the connector 20 provided by the combination of seawater and heat storing members 30*a-d* in the heat bank 10 of the present disclosure result in the particularly effective improvement in cool-down time. To enhance these effects further, different embodiments of heat storing members 30*a-d* have been devised, as shown in FIGS. 2 to 4.

Figure 2:
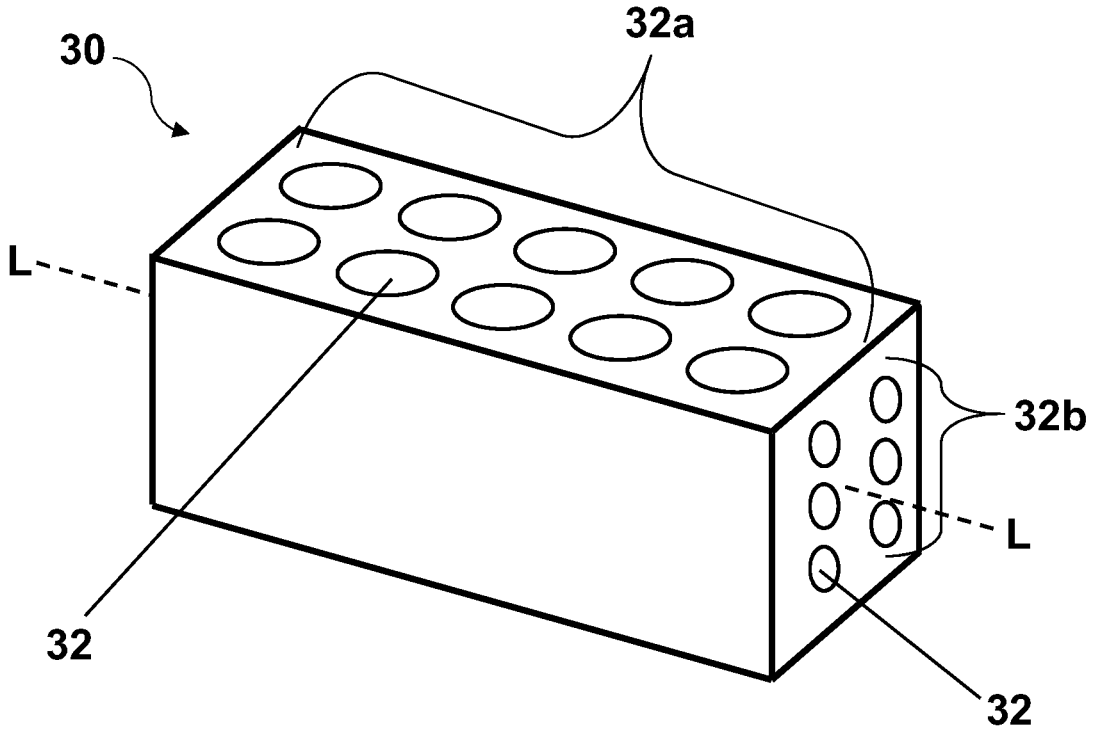
FIG. 2 shows a heat storing member in accordance with one embodiment of the present disclosure.
Figure 3:
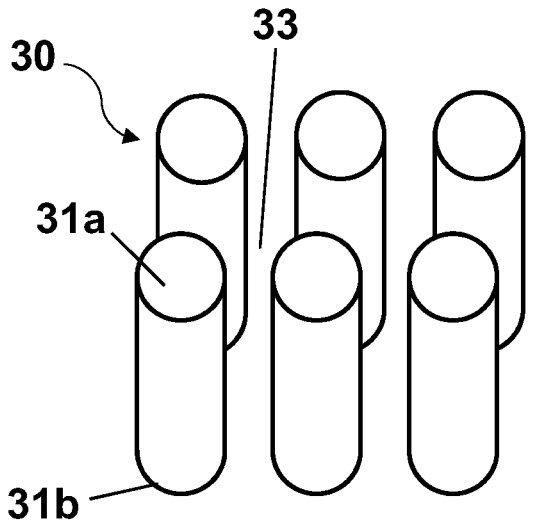
FIG. 3 shows a heat storing member in accordance with another embodiment of the present disclosure.
Figure 4:
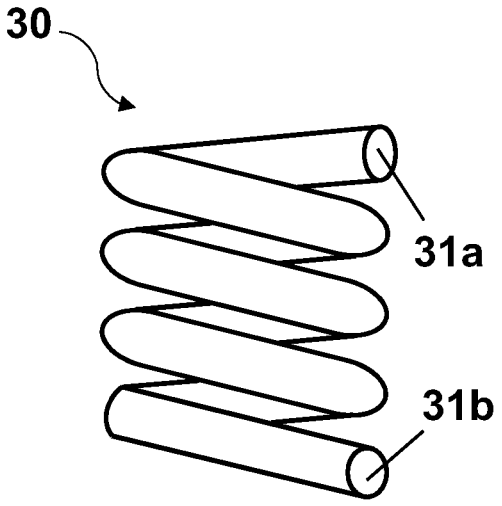
FIG. 4 shows a heat storing member in accordance with another embodiment of the present disclosure.

As shown in FIGS. 2 to 4, the heat storing member(s) 30 generally include a container that encloses and seals PCM therein. In this manner, the container is closed to the surrounding seawater in the internal space 14 and the PCM therein is sealed therefrom. Heat that is stored and released from the PCM in the container will be communicated to the surrounding seawater and/or connector 20 via conduction through the container (i.e., through walls of the container).

The containers shown are rigid containers comprising rigid container walls between which the PCM is enclosed. The container can be made from any suitable material, such as a plastic or metal material.

In other embodiments (not depicted), the container is a flexible container e.g., made from a flexible plastic/film material. In this sense, the container may be a flexible bag-type container that allows some deformation of the container. This can make it easier to mould the heat storing members 30 around certain parts of the connector 20 and heat bank 10, as may be necessary.

As shown in FIG. 2, the container is substantially brick shaped. In other words, it is substantially shaped like a rectangular cuboid. This brick shaped container may provide a more standardised shape for the heat storing member 30, such that multiple containers can be manufactured and used in a more modular fashion. Nonetheless, the container can be made into any other suitable shape, as may be needed to fit in a particular heat bank and subsea element geometry.

As also shown in FIG. 2, the container defines a plurality of fluid channels 32 therein. The fluid channels 32 pass through the container to allow communication of seawater from the internal space 14 through the container without contacting the PCM sealed within the container. Accordingly, the exterior of the container walls define the fluid channels 32.

The fluid channels 32 allow seawater to better circulate around and through the container, which improves the thermal communication between the PCM and the seawater. This can permit improved conduction of heat stored and released from the PCM to the seawater, which can help further maximise the heating effect and cool-down time provided by the heat bank 10.

To increase this effect further, the depicted embodiment shows two sets of fluid channels 32 extending vertically and horizontally through the container. The vertically orientated set of fluid channels 32*a* extend transversely to the longitudinal axis L of the heat storing member 30, whereas the horizontally orientated set of fluid channels 32*b* extend parallel to the longitudinal axis L. The sets of fluid channels 32*a*, 32*b* are also arranged in a grid-like pattern. The fluid channels 32*a*, 32*b* may also intersect with each other and coalesce to improve seawater mixing against the container walls. Of course, any other suitable number (e.g., at least one), arrangement and orientation of fluid channels 32, 32*a*, 32*b* can be provided within the scope of the present disclosure.

Referring to FIGS. 3 and 4, alternative arrangements of the heat storing member 30 are shown. In these embodiments, the heat storing member 30 includes a container that is in the form of a closed tubular element. In this manner, the container is a tubular element having opposed closed ends 31*a*, 31*b*. The PCM is sealed within the tubular container between the closed ends 31*a*, 31*b*

In the embodiment shown in FIG. 3, the closed tubular element is a straight cylindrical tube extending between opposed closed ends 31*a*, 31*b*. In the embodiment shown in FIG. 4, the tube extends in the form of a helix (i.e., a spiral shape) between opposed closed ends 31*a*, 31*b*.

It is thought that the tubular container shapes of FIGS. 3 and 4 permit a high amount of surface area of the container to be in contact with the surrounding seawater and thus improve thermal communication between the seawater and the PCM contained in the tubular containers. For example, in the helical container of FIG. 4, seawater can flow between the turns of the helix shape and flow along the centre of the helix shape.

In a further embodiment, shown in FIG. 3, a plurality of tubular heat storing members 30 can be positioned together in an array, for example, in a grid-like pattern. This can provide further enhancements in thermal communication between the PCM and seawater, as the seawater can mix further in gaps 33 defined between the array of tubular elements.

Although specific embodiments are shown, any other suitable shapes and forms of heat storing members 30 that may be apparent to the skilled person can be provided within the scope of the present disclosure. Moreover, the heat storing members used in a given heat bank can be a combination of different types. For example, brick shaped containers can be used in combination with closed tubular containers, as needed.

In order to preserve the heating effect around the connector 20, the depicted external casing 12 includes an insulating coating on the exterior thereof for thermally insulating the external casing from ambient seawater surrounding it. This slows the cooling of the internal space 14 and connector 20 by the cooler ambient seawater surrounding the heat bank 10.

The insulating coating can be any suitable insulating material, such as a resin, foam or thermoplastic. One particularly suitable example includes a syntactic foam, such as a syntactic silicone foam or a syntactic epoxy foam.

The external casing 12 could alternatively or additionally be made of a suitable insulating material itself.

Although the embodiments of the present disclosure have been described primarily with reference to subsea connectors, the scope of the present disclosure and its benefits are not limited to such, and extend to any other element(s) of a subsea installation where a subsea heat bank may be usefully applied (i.e., not just around a connection between two elements). Such subsea heat banks may be used (for example) around valves, sections of pipeline, manifold spools and Christmas tree spools, or the like.

The invention claimed is:

1. A subsea heat bank for thermally insulating one or more elements of a subsea installation, wherein the one or more elements of the subsea installation are for communicating a flow path of well fluid there through having a flow temperature and a lower hydrate formation temperature at which hydrates will form in the well fluid, the heat bank comprising:

an external casing enclosing an internal space configured to accommodate seawater having a heat-storing capacity therein;

the one or more elements of the subsea installation being received in the internal space and arranged such that the seawater surrounds the one or more elements so as to allow the seawater to delay cooling of the one or more elements by heat stored in the seawater; and at least one heat storing member provided in the internal space for increasing the heat storing capacity of the heat bank;

wherein the heat storing member comprises a phase change material (PCM) that has melting point which is below that of the flow temperature of the well fluid and above the hydrate formation temperature of the well fluid;

wherein the heat storing member comprises a container enclosing and sealing the PCM therein, and the container defines at least one fluid channel therein for communicating seawater from the internal space through the container without contacting the PCM sealed within the container.

2. The subsea heat bank of claim 1, wherein the container is substantially brick shaped.

3. The subsea heat bank of claim 2, wherein the container defines a first set of fluid channels extending vertically through the container and a second set of channels extending horizontally through the container.

4. The subsea heat bank of claim 1, wherein the container is a closed tubular element.

5. The subsea heat bank of claim 4, wherein the container is a closed helical tubular element.

6. The subsea heat bank of claim 4, wherein a plurality of tubular element containers are arranged in an array.

7. The subsea heat bank of claim 1, wherein the heat storing member is attached to the external casing.

8. The subsea heat bank of claim 1, wherein the heat storing member is in physical contact with a portion of the one or more elements.

9. The subsea heat bank of claim 1, wherein the external casing includes an insulating coating on the exterior thereof for thermally insulating the external casing from ambient seawater surrounding it.

10. The subsea heat bank of claim 1, wherein plurality of heat storing members are arranged within the internal space and around the one or more elements.

11. The subsea heat bank of claim 1, wherein the one or more elements of the subsea installation provide a subsea connector.

12. The subsea heat bank of claim 11, wherein the subsea connector is a horizontal clamp connection system (HCCS).

13. The subsea heat bank of claim 12, wherein the heat storing member is positioned around the vicinity of a clamp of the HCCS for securing sections of pipeline together.

14. A subsea heat bank for thermally insulating one or more elements of a subsea installation, wherein the one or more elements of the subsea installation are for communicating a flow path of well fluid there through having a flow temperature and a lower hydrate formation temperature at which hydrates will form in the well fluid, the heat bank comprising:

an external casing enclosing an internal space configured to accommodate seawater having a heat-storing capacity therein;

the one or more elements of the subsea installation being received in the internal space and arranged such that the seawater surrounds the one or more elements so as to allow the seawater to delay cooling of the one or more elements by heat stored in the seawater; and at least one heat storing member provided in the internal space for increasing the heat storing capacity of the heat bank;

wherein the heat storing member comprises a phase change material (PCM) that has melting point which is below that of the flow temperature of the well fluid and above the hydrate formation temperature of the well fluid; and wherein the container defines a first set of fluid channels extending vertically through the container and a second set of channels extending horizontally through the container.

15. The subsea heat bank of claim 14, wherein the heat storing member is in physical contact with a portion of the one or more elements.

16. A subsea heat bank for thermally insulating one or more elements of a subsea installation, wherein the one or more elements of the subsea installation are for communicating a flow path of well fluid there through having a flow temperature and a lower hydrate formation temperature at which hydrates will form in the well fluid, the heat bank comprising:

an external casing enclosing an internal space configured to accommodate seawater having a heat-storing capacity therein;

the one or more elements of the subsea installation being received in the internal space and arranged such that the seawater surrounds the one or more elements so as to allow the seawater to delay cooling of the one or more elements by heat stored in the seawater; and at least one heat storing member provided in the internal space for increasing the heat storing capacity of the heat bank;

wherein the heat storing member comprises a phase change material (PCM) that has melting point which is below that of the flow temperature of the well fluid and above the hydrate formation temperature of the well fluid; and wherein the heat storing member is in physical contact with a portion of the one or more elements.

17. The subsea heat bank of claim 16, wherein the heat storing member comprises a container enclosing and sealing the PCM therein.

18. The subsea heat bank of claim 16, wherein the container defines at least one fluid channel therein for communicating seawater from the internal space through the container without contacting the PCM sealed within the container.

* * * * *